US005868391A

United States Patent [19]

Abood

[11] Patent Number: 5,868,391

[45] Date of Patent: Feb. 9, 1999

[54] CARD GAME

[76] Inventor: Bryce Abood, 5309 E. Arlene, Wichata, Kans. 67762

[21] Appl. No.: 940,901

[22] Filed: Sep. 30, 1997

[51] Int. Cl.[6] ..... A63F 1/04

[52] U.S. Cl. ..... 273/292

[58] Field of Search ..... 273/292, 146, 273/274

[56] References Cited

U.S. PATENT DOCUMENTS

| | | | |
|---|---|---|---|
| 5,669,606 | 9/1997 | Brown | 273/292 X |
| 5,676,375 | 10/1997 | Pirouzkhah | 273/292 X |
| 5,683,088 | 11/1997 | Rose | 273/146 X |
| 5,695,192 | 12/1997 | Brown | 273/292 X |
| 5,700,010 | 12/1997 | Mimier | 273/292 |

*Primary Examiner*—William E. Stoll
*Attorney, Agent, or Firm*—Hopgood, Calimafde, Kalil & Judlowe

[57] ABSTRACT

A method and a set of cards are provided for playing a game of cards using at least one die having a plurality of faces with numbers thereon ranging from 1 on one face of the die to succeeding numbers on the remaining faces on the dice. The method comprises providing a deck of cards in which each one of the cards has a working indicia on one face thereof; the deck of cards being arranged with the indicia concealed face down as in a standard deck of cards. At least one die is randomly thrown on a surface until it comes to rest and exposes a number on an exposed face thereof. A subset of cards is removed from the top of the deck of cards with the indicia concealed, the subset cards being equal in number to the number exposed on at least one die. A player who threw the die makes a guess as to the presence of a card of a particular indica in the subset. The cards of the subset are exposed and if the card previously selected is present in the exposed subset, the player keeps the subset as a win. If the card selected by the player is not in the subset, the subset is discarded. The game is continued with the remaining deck of cards until the game has been completed.

6 Claims, 1 Drawing Sheet

CARD GAME

This invention relates to a card game and, in particular, to a card game capable of being played by one or more persons.

Where a single player is involved, the player plays against the cards, such as in a game of solitaire.

Preferably the game is played with two or more players with the players playing against each other.

Except for solitaire, most card games involve plural players, such as bridge, rummy, casino, whist and the like.

It is preferred to play with a standard deck of playing cards, although any deck of cards may be employed having other forms of indicia on the face of each card. In a standard deck of cards, the indicia comprise four cards of specified value ranging from two to ten and including four cards of each of the ace, king, queen and jack.

The term indicia is used herein in both plural and singular sense.

Other forms of indicia on the face of the cards may include four cards containing a monkey, four cards containing a giraffe, four cards containing an elephant, four cards containing a tiger, etc., the cards of each indicia constituting thirteen sets of fours or a total of fifty two cards as in a standard deck.

However, the deck of cards may not be limited to fifty two cards. The deck may contain less and more than fifty two cards.

In fact, if there are four or more card players, it may be desirable to use a set of cards containing two standard decks or a total of 104 cards. This would keep the game in progress for a longer period of time.

THE DRAWING

As illustrative of the invention, reference is made to FIGS. 1–4 of the drawing, wherein.

OBJECTS OF THE INVENTION

Figure 1:
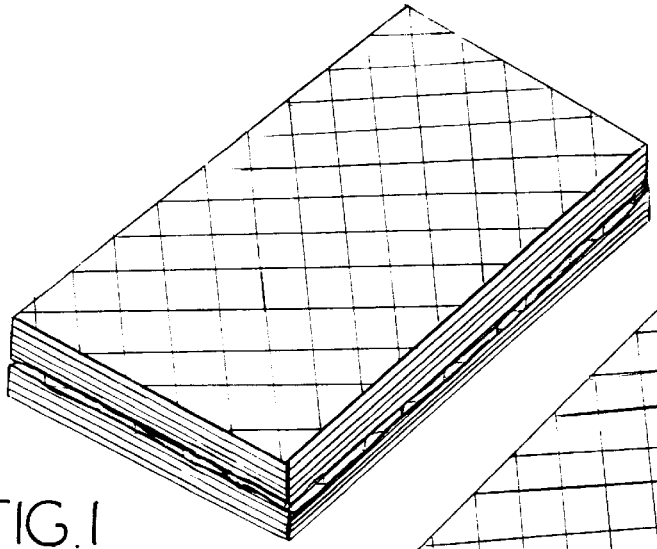
FIG. 1 is a deck of cards arranged face down.
Figure 3:
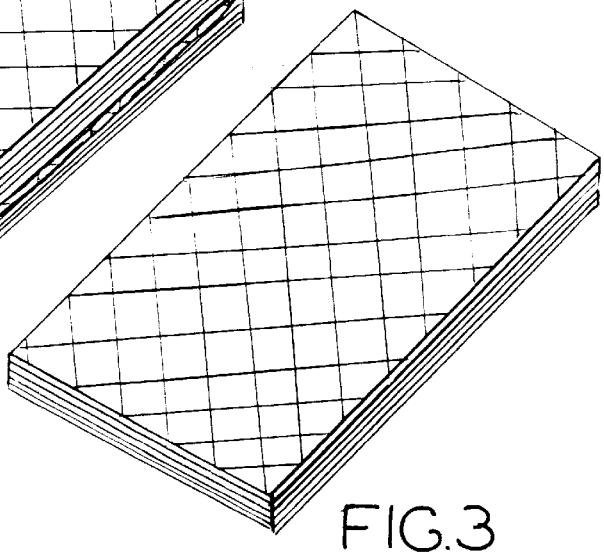
FIG. 3 is a portion or subset of the deck of cards comprising in this case a total of five cards corresponding to the number 5 on the face of the dice.
Figure 2:
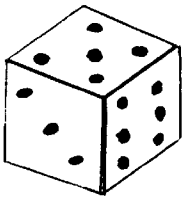
FIG. 2 is one embodiment of a dice showing an indicia of 5 on the face thereof in a played position.
Figure 4:
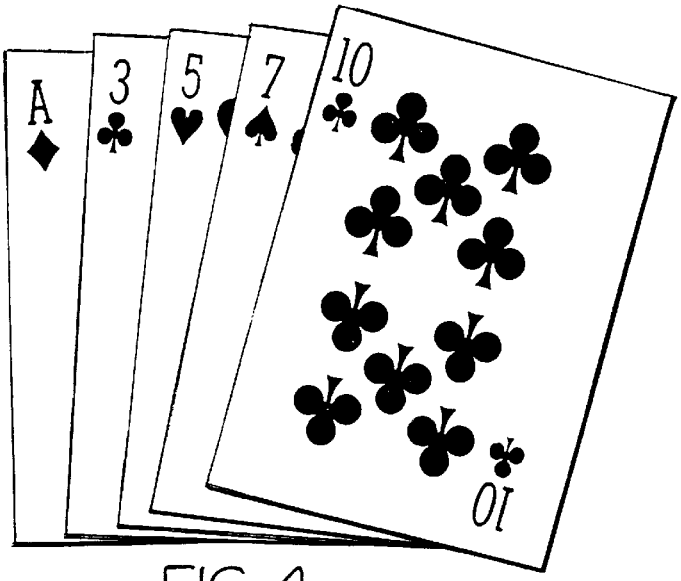
FIG. 4 is an exposed spread of the five cards from FIG. 3 following a guess made by a player.

It is an object of the invention to provide a card game which is played with at least one dice;

Another object of the invention is to provide a card game involving one or more players;

A preferred object of the invention is to provide a card game involving two or more players as opponents using at least one dice, the term dice being used in both the singular and plural sense.

These and other objects will more clearly appear from the following disclosure and the appended claims.

SUMMARY OF THE INVENTION

Broadly speaking, the present invention comprises a method of playing a game of cards by using a deck of cards and also at least one dice having numbers thereon, ranging serially from one face to another.

A standard dice containing six faces with numbers ranging from 1 to 6 on the faces thereof may be used.

Another dice which may be used is a dice having the shape of an octahedron with 8 faces which can be numbered from 1 to 8. A still another dice which may be employed is a dodecahedron which has 12 faces numbered from 1 to 12.

In general the game is played between at least two players, preferably using a standard deck of cards, although a player can play alone as in solitaire.

Stating it broadly, the invention is directed to a method of playing a game of cards with a deck of cards using at least one dice having numbers ranging from 1 to the succeeding numbers on the remaining faces of the dice. In case of a standard dice, the numbers range from 1 to 6. In the case of an octahedron, the numbers on the faces range from 1 to 8, etc.

In a preferred embodiment, the method comprises providing a standard deck of cards face down with the indicia concealed. A dice is thrown randomly on a surface until a number comes up. A subset of cards corresponding to the number on the face of the dice is removed from the top of the deck and placed face down on the surface.

A guess is then made by a player who threw the dice as to a particular card in the subset. The particular card selected may be just its value or may include the suit as well. The cards constituting the subset are turned over and if the card guessed by the player is in the subset, the player keeps the subset as a win.

If the card selected is not in the subset, the cards are put in a pile and referred to as discards.

The game is completed when the deck has been used up.

If a player is playing alone, the subsets he keeps are counted and compared to those discarded. If he has more cards than those discarded, he wins, etc,

DETAILS OF THE INVENTION

Game No. 1

Two players decide to play against each other as opponents.

A coin is tossed to determine who is the first player. The toss is won by player No. 2.

Player No. 2 throws a dice on a table and obtains the No. 5 on the face of the dice.

A subset of cards containing five cards is removed from the top of the deck and placed face down on the table. Player No. 2 makes the guess that a 6 spot would be present in the subset. The subset is turned over to reveal the cards present. No. 6 is not present and the cards are discarded to one side of the table.

Player No. 1 now has the dice which he throws on the table. The number 4 on the dice shows up. The player removes a subset of four from the top of the deck which he places on the table face down.

Player No. 1 makes a guess that a 5 spot may be present and he wins. He keeps the four cards.

Since he won, he can throw the dice again.

Player No. 1 throws the dice again and a six appears on the dice. Six cards are removed from the top as a subset and placed on the table face down. Player No. 1 makes a guess that a 9 will be present. He turns over the subset of cards and finds a nine and he keeps the cards.

Since he has won, he can play again until he loses and player No. 2 takes over.

The game is continued until the deck of cards is consumed and the winner determined by the number of cards won.

Game No. 2

In this game, two decks of cards are employed and the game played with three or more players.

The same procedure is followed until there is a winner.

Many variations of the game can be played.

For example, in using two deck of cards with multiple players, e.g., four players, a dice in the form of an octahedron may be employed to speed up the game, especially with the numbers on the dice ranging from 1 to 8.

The variation of the game may include a situation in which the discards are quite substantial. In that case, the discards may be reshuffled and the game continued until a winner is determined.

The foregoing game is particularly attractive to family participation. Since the dice is crucial to the playing of the game, the game has broad appeal to all age groups in a family.

The term "working indicia" is intended to mean the indicia on a face of a card with which the game is played.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. A method of playing a game of cards with a deck of cards and at least one die having a plurality of faces having numbers thereon ranging from 1 on one face of the die to succeeding numbers on the remaining faces on said at least one die; which comprises:

providing a deck of said cards in which each one of said cards has a working indicia on one face thereof;

said deck of cards being arranged with the indicia concealed face down as in a standard deck of cards;

randomly throwing said at least one die on a surface until it comes to rest and exposes a number on an exposed face thereof;

removing a subset from the top of said deck of cards with the indicia concealed, the subset cards being equal in number to the number exposed on said at least one die;

allowing a player who threw the at least one die to make a guess as to the presence of a card of a particular indica in said subset;

exposing the cards of said subset and if the card previously selected is present in said subset said player keeps the subset as a win;

if the card selected by said player is not in said subset, said subset is discarded; and continuing said game with the remaining deck of said cards until the game has been completed.

2. The method of claim 1, wherein the deck of cards is a standard deck of playing cards.

3. The method of claim 1, wherein the working indicia represented on the card comprise figures of animals or other forms.

4. The method of claim 1, wherein at least two players as opponents are included in the card game.

5. The method of claim 4, wherein at least two decks of cards are used and shuffled together.

6. A method of playing a game of cards involving at least two players using a deck of cards and at least one die having a plurality of faces having numbers thereon ranging from 1 on one face of the dice to succeeding numbers on the remaining faces on said at least one die; which comprises:

providing a deck of said cards in which each one of said cards has a working indicia on one face thereof; said deck of cards being arranged with the indicia concealed face down as in a standard deck of cards allowing a player to randomly throw said at least one die on a surface until it comes to rest and exposes a number on an exposed face thereof;

removing a subset from the top of said deck of cards with the indicia concealed, the subset cards being equal in number to the number exposed on said at least one die;

allowing said player who threw the at least one die to make a guess as to the presence of a card of a particular indica in said subset;

exposing the cards of said subset and if the card previously guessed by said player is present in said subset said player keeps the subset as a win;

if the card selected by said player is not in said subset, said subset is discarded and the next player then throws said at least one die; and continuing said game with the remaining deck of said cards until the game has been completed between said players.

* * * * *